US009683404B2

(12) United States Patent
Baumann et al.

(10) Patent No.: US 9,683,404 B2
(45) Date of Patent: Jun. 20, 2017

(54) SPACER FOR INSULATING GLASS PANES

(71) Applicant: Ensinger GmbH, Nufringen (DE)

(72) Inventors: Thomas Baumann, Nagold (DE); Marc Rehling, Steinenbronn (DE)

(73) Assignee: ENSINGER GMBH, Nufringen (DE)

( * ) Notice: Subject to any disclaimer, the term of this patent is extended or adjusted under 35 U.S.C. 154(b) by 0 days.

(21) Appl. No.: 14/579,520

(22) Filed: Dec. 22, 2014

(65) Prior Publication Data

US 2015/0107167 A1 Apr. 23, 2015

Related U.S. Application Data

(63) Continuation of application No. PCT/EP2013/063691, filed on Jun. 28, 2013.

(30) Foreign Application Priority Data

Jul. 4, 2012 (DE) ..... 10 2012 105 960
Oct. 19, 2012 (DE) ..... 20 2012 104 026 U

(51) Int. Cl.
*E06B 3/66* (2006.01)
*E06B 3/663* (2006.01)

(52) U.S. Cl.
CPC ..... *E06B 3/66328* (2013.01); *E06B 3/66319* (2013.01); *E06B 3/66333* (2013.01);
(Continued)

(58) Field of Classification Search
CPC ..... E06B 3/66333; E06B 3/66328; E06B 3/66319; E06B 3/66314; E06B 3/67313;
(Continued)

(56) References Cited

U.S. PATENT DOCUMENTS 5,106,663 A * 4/1992 Box ..... E06B 3/66342 156/109
5,460,862 A 10/1995 Roller
(Continued)

FOREIGN PATENT DOCUMENTS

AT 380527 B * 6/1986 ..... B21D 11/10
AU 2003-206770 A1 9/2003
(Continued)

OTHER PUBLICATIONS

International Bureau, International Search Report in International Patent Application PCT/EP2013/063691, mailed Oct. 10, 2013.

*Primary Examiner* — Christine T Cajilig
(74) *Attorney, Agent, or Firm* — Jeremy Jay

(57) ABSTRACT

A spacer for insulating glass panes has a profile body having a cross section having first and second side walls, an inner wall and an outer wall, forming a closed hollow profile, wherein first and second filamentary reinforcing elements are arranged in the inner wall, the first primary reinforcing element being arranged in a first portion of the cross section in which the inner wall adjoins the first side wall, and the second reinforcing element being arranged in a second portion of the cross section in which the inner wall adjoins the second side wall, the first and second primary reinforcing elements being arranged, as regards their cross sectional surfaces, at most approximately 50% in the first and/or in the second side wall, and such that spacing between the centroids of the cross sectional surfaces of these reinforcing elements is approximately 40% or more of spacing between the side walls.

29 Claims, 9 Drawing Sheets

(52) U.S. Cl.
CPC ..... *E06B 2003/6638* (2013.01); *E06B 2003/66385* (2013.01)

(58) Field of Classification Search
CPC ..... E06B 3/663; E06B 3/66361; E06B 2003/6638; E06B 2003/66385
USPC ..... 52/786.13
See application file for complete search history.

(56) References Cited

U.S. PATENT DOCUMENTS

| | | | | |
|---|---|---|---|---|
| 5,640,828 | A * | 6/1997 | Reeves | B29C 53/08 428/34 |
| 5,687,596 | A * | 11/1997 | Vianello | E06B 3/67313 72/14.8 |
| 6,250,045 | B1 | 6/2001 | Goer et al. | |
| 6,370,838 | B1 * | 4/2002 | Evason | E06B 3/66352 52/204.593 |
| 6,389,779 | B1 | 5/2002 | Brunnhofer | |
| 8,640,406 | B2 | 2/2014 | Brunnhofer et al. | |
| 8,756,879 | B2 * | 6/2014 | Cempulik | E06B 3/66319 52/172 |

FOREIGN PATENT DOCUMENTS

| | | | | |
|---|---|---|---|---|
| DE | 92 14 799 | U1 | 12/1992 | |
| DE | 93 03 795 | U1 | 8/1994 | |
| DE | WO 9802632 | A1 * | 1/1998 | B32B 17/10036 |
| DE | 198 07 545 | A1 | 8/1999 | |
| DE | 199 61 902 | A1 | 12/1999 | |
| DE | 102 26 269 | A1 | 6/2002 | |
| DK | WO 8907495 | A1 * | 8/1989 | B21D 7/06 |
| DK | WO 2008017590 | A1 * | 2/2008 | E06B 3/66314 |
| EP | 0 601 488 | A2 | 6/1994 | |
| EP | 0 953 716 | A2 | 11/1999 | |
| EP | 1 055 046 | A1 | 11/2000 | |
| GB | 2 162 228 | A | 1/1986 | |
| WO | WO 99/41481 | A1 | 8/1999 | |
| WO | WO 03/074830 | A1 | 9/2003 | |
| WO | WO 2011/091986 | A2 | 8/2011 | |

* cited by examiner

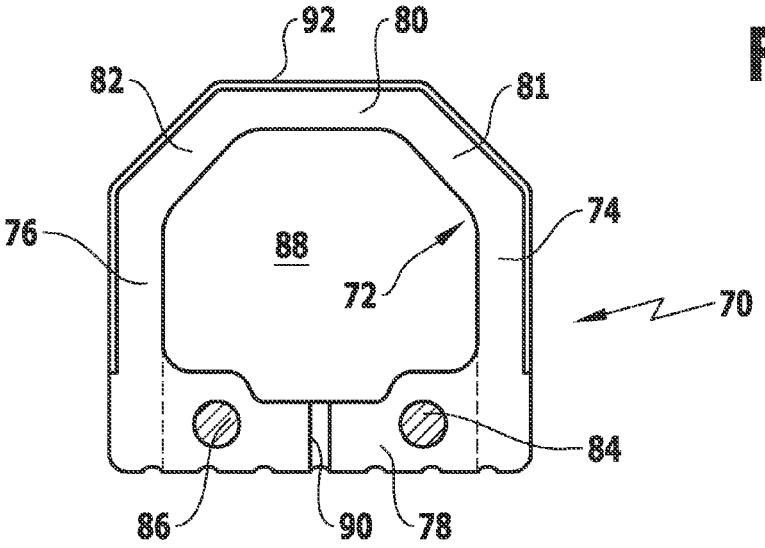
FIG.3
FIG.4
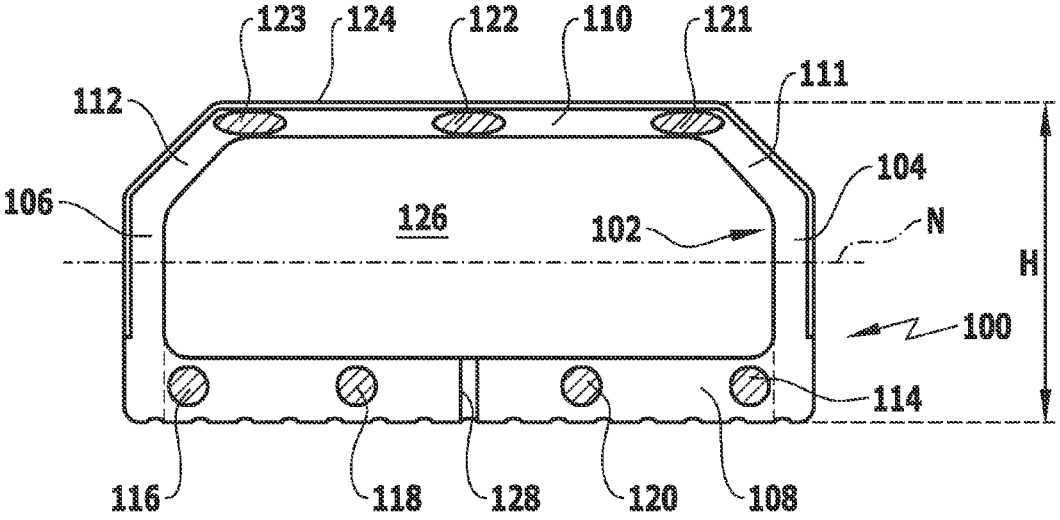

SPACER FOR INSULATING GLASS PANES

CROSS-REFERENCE TO RELATED APPLICATIONS

This patent application is a Continuation of PCT Application PCT/EP2013/063691 filed on Jun. 28, 2013, which claims the benefit and right of priority of German Patent Applications DE 10 2012 105 960.8, filed Jul. 4, 2012, and DE 20 2012 104 026.3, filed on Oct. 19, 2012, which are each incorporated by reference.

BACKGROUND OF THE INVENTION

The invention relates to a spacer for insulating glass panes, including a profile body made from a plastics material which has a substantially rectangular cross section having first and second mutually parallel side walls and an inner wall that extends between the first and the second side wall, and an outer wall that extends between the first and the second side wall, substantially parallel to the inner wall, and with the profile body forms a closed hollow profile.

Many different spacers of this kind are known in the prior art and are used in the context of improving heat insulation in insulating glass panes of windows and doors, facade elements and the like, in place of the previously usual metal spacers, to keep two glass panes at a spacing from one another. To this end, endless or rod-shaped material is bent, typically by cold forming, to give a frame that corresponds to the size of the window, door, etc.

At the same time, the spacers have by means of their hollow profile the task of receiving desiccants such that the intermediate space between the panes that is formed in the insulating glass pane remains substantially free of water vapour and so condensation effects can be avoided in the event of large differences between the internal and external temperature.

German utility model DE 93 03 795 U1 and European patent application EP 0 601 488 A2 each disclose plastics spacers for insulating glass panes in which metal reinforcing elements are embedded in the plastics material, wherein metal foils are embedded in the side walls and the outer wall and metal foils and/or filamentary reinforcing elements are embedded in the inner wall. The term "filamentary reinforcing elements" is understood to mean reinforcing elements in the form of wire or tubes, and these may in particular also take the form of a cord formed of strands, or of a helical wire, for example of steel or aluminium. Here, the dimensioning of the reinforcing elements arranged in the inner wall is such that this wall is stabilised and strengthened, with the result that it is not to be deformed by thermal expansion or solar irradiation.

In contrast, WO 1999/041481 A1 discloses a spacer for insulating glass panes in which reinforcing elements, either in the form of wires or flat or angled profiles, are arranged in particular in the side walls and corner regions of the substantially rectangular profile, and by means of these reinforcing elements deformability of the spacer profile is sought, similar to that known from the metal spacers, such that conventional bending equipment may be used for cold bending the plastics spacer profiles.

WO 2011/091986 A2 uses large-surface metal materials, as already known from EP 0 601 488 A2, for reinforcing the plastics hollow profiles, wherein the reinforcing elements are arranged on the outside of the outer wall and the side walls, while they are embedded in the plastics material in the inner wall or are mounted on the surface of the inner wall by means of an adhesion promoter.

BRIEF SUMMARY OF THE INVENTION

The object of the present invention is to propose a spacer which may on the one hand be deformed using conventional equipment by the cold bending method but at the same time offers the greatest possible resistance to heat transfer.

This object is achieved according to the invention by a spacer for insulating glass panes having the features of claim 1.

Unlike the prior art, according to the invention the primary reinforcing elements in the form of a first and second filamentary reinforcing element are arranged in a first and a second portion of the cross section of the profile body in which the inner wall adjoins the respective side wall, wherein the first and second primary reinforcing elements are arranged, as regards their cross sectional surface, at most approximately 50% in the first and/or in the second side wall.

Moreover, it is significant in the present invention that the spacing between the centroids of the cross sectional surfaces of the reinforcing elements is approximately 40% or more of the spacing between the side walls, but at least approximately 4 mm.

On the basis of these measures, it is possible on the one hand to cold form the spacer according to the invention using conventional bending devices which are also used for bending the metal spacers. On the other hand the particular selection of the reinforcing elements prevents the heat transfer resistance of the profile body of plastics material from being appreciably reduced by the incorporation of the reinforcing elements. Furthermore, the reinforcing elements in the cross section of the profile body are arranged according to the invention such that they do not hamper the cold bending procedure and on the other hand the appearance, that is to say the surface quality of the spacer in the corner region, is not impaired.

In contrast to the teaching of EP 0 601 488 A2, the invention is supported by the deformability of the plastics profile that is provided with the reinforcing elements such that corner regions can be formed in a cold bending procedure using conventional bending devices. As a result of the particular selection and arrangement of the primary reinforcing elements, at the same time the geometry of the inner wall is stabilised and yet the construction of corner regions in a bending procedure is made possible.

The outer wall is preferably also made from plastics material, wherein the plastics material of the outer wall is preferably compatible or identical with the plastics material of the profile body, and wherein it is further preferred for the outer wall to be constructed in one piece with the profile body, in particular being extruded.

In a preferred embodiment of the present invention, the spacing between the centroids of the cross sectional surfaces of the primary reinforcing elements is approximately 50% or more of the spacing between the side walls, but at least approximately 5 mm.

It is further preferred for the first and second primary reinforcing structures to be arranged exclusively in the region of the inner wall and it is most preferred for their outer contours to maintain a predetermined spacing from the side walls.

The filamentary primary reinforcing elements that are used according to the invention may be made from wire, may be used as hollow bodies (tubes) or indeed in the form of a cord formed of strands, wherein the cross section may be constructed to be polygonal, for example rectangular, in particular square, round or oval.

Preferably, the surface of the primary reinforcing elements has a structure which is in particular knurled, fluted or an externally threaded structure. As an alternative or in addition, the surface of the primary reinforcing elements may be provided with a coating of adhesion promoter.

In order to impede or even prevent the diffusion of water vapour from the environment of the insulating glass panes into the interior, according to a variant of the invention at least the outer wall is provided with a diffusion barrier to water vapour, wherein the diffusion barrier is preferably selected from metal or plastics foils that are impermeable to water vapour, a metal coating that is applied to the hollow profile, or a plastics coating that is applied to the hollow profile or where appropriate co-extruded with the hollow profile.

In another variant of the present invention, the outer wall may itself form the diffusion barrier and be made for example from a metal foil. In that case, it typically acts as a further reinforcing element at the same time.

Because of the primary reinforcing elements provided according to the invention, the diffusion barrier, which was also used quite deliberately as a reinforcing element in the prior art, may take a form which is unrelated to the aspect of reinforcing the spacer. Thus, the diffusion barrier may also have very thin walls, with the result that, in particular when using metal diffusion barriers, the contribution they make to thermal conduction may be significantly reduced.

According to the invention, therefore, the diffusion barrier need not necessarily take on the function of a reinforcing element. For this reason, metal coatings having coating thicknesses well below 0.1 mm (for example approximately 0.01 to approximately 0.03 mm) are also suitable, including those that are applied by vapour deposition, or non-metallic coatings having the properties of a diffusion barrier.

If diffusion barriers made from metal are used, typically in the form of metal foils that at the same time act as reinforcing elements, then in contrast to what is proposed in some of the prior art they may take a form having relatively little overlap with the side walls. The longitudinal edges of the metal foils then maintain a relatively large spacing from the surface of the inner wall, with the consequence that portions of the metal foil of a smaller surface area are arranged in a region of the side walls, which undergo buckling during bending of the spacer to form a corner.

Metal foils that act as diffusion barriers and as reinforcing elements are preferably made from steel or stainless steel.

Metal foils, in particular made from steel or stainless steel, which act as diffusion barriers and as reinforcing elements preferably have a high elongation at break of approximately 40% or more and are in particular annealed or solution-annealed.

Metal foils having a high elongation at break, on the one hand, and plastics materials with no glass fibre content, on the other, reduce the buckled zone when the spacer profile is deformed on forming a corner. In this way, the formation of a fold in the metal foil in the region of the corners that are produced by bending is minimised, as is the change in the colour of the plastics material which is sometimes observed on compression.

Possible plastics materials that may be used for the hollow profile are polypropylene (PP), polycarbonate (PC), polyvinyl chloride (PVC), styrene/acrylonitrile synthetic (SAN), polyamide (PA) polyester (e.g. PET) and/or acrylonitrile/butadiene/styrene synthetic (ABS).

Typically, a weight ratio between the weight of the primary reinforcing elements on the one hand and the weight of the plastics material of the profile body (or of the hollow profile, if the outer wall is also made from plastics) on the other is selected in the range of approximately 1:6 to approximately 2:1.

When using diffusion barriers that do not act as a reinforcing element, the weight ratio between the weight of the primary reinforcing elements on the one hand and the weight of the plastics material on the other is preferably in the range of approximately 1:2 to approximately 2:1.

On the one hand, this allows the plastics materials of the profile body/hollow profile to be made strong enough for processing to be simple and, as is conventional for metal hollow profiles, possible by the cold bending method; on the other, the content of metallic materials is small enough and is positioned in suitable cross sectional regions of the profile body for the heat transfer resistance of the hollow profile to remain at a high enough level overall.

Where appropriate, the plastics material(s) of the profile bodies/hollow profiles of the spacers according to the invention may have reinforcing fibres embedded in them, in particular glass fibres, carbon fibres and aramid fibres, although the content of these is preferably limited to approximately 20 weight % or less, in particular 10 weight % or less. Most preferred are spacers in which the plastics material is substantially free of reinforcing fibres.

The low content of reinforcing fibres, in particular glass fibres, or the substantially complete absence of the use of reinforcing fibres, is significant because this gives an improvement in the heat transfer resistance, which is typically reduced by the arrangement of reinforcing fibres in the plastics material. Reinforcing fibres, in particular glass fibres, typically have significantly greater thermal conductivity than the plastics material surrounding them.

Unlike the reinforcing elements of the spacers according to the invention, which are each arranged parallel to the longitudinal direction of the spacer and hence transversely to the direction of heat transfer, and although the reinforcing fibres may be embedded in the plastics material partly oriented to the longitudinal direction, it is impossible to avoid an arrangement diverging from this, with a component transverse to the longitudinal direction of the spacer and hence in the direction of heat transfer, and for this reason the presence of reinforcing fibres typically results in a reduction in the heat transfer resistance.

The spacers according to the invention include in their plastics material typical additives, in particular selected from filters, pigments, light stabilisers, impact modifiers, antistatic agents and/or flame retardants.

Typical representatives of fillers are talc, glass balls and chalk. As regards pigments, typical representatives that may be mentioned are titanium dioxide and carbon black. Possible light stabilisers which may be used are in particular UV stabilisers and antioxidants. As flame retardants, there may be mentioned by way of example halogen-free flame retardants based on phosphorus-nitrogen compounds.

In preferred spacers according to the present invention, the inner wall has a thickness, in the regions in which the primary reinforcing elements are arranged, which is approximately 1× to approximately 2.5×, in particular 1.5 to approximately 2.5×, the extent of the cross section of the primary reinforcing elements in the direction of the thickness of the inner wall.

If the thickness is limited to approximately 1× the extent of the primary reinforcing elements, the reinforcing elements are only partly embedded in the inner wall and project beyond the inner wall into the hollow space in the hollow profile, for example by a third of their extent in the direction of the thickness of the inner wall.

If the inner wall has a thickness of approximately 1.5× the extent of the cross section or more, it is possible to completely embed the primary reinforcing elements in the inner wall Preferably, the thickness of the inner wall is reduced, directly adjacent to the side walls, by comparison with adjoining regions in the direction of the profile centre. The primary first and second reinforcing elements are in this case preferably arranged with their cross section completely in the region of the inner wall and furthermore preferably maintain from their outer contours a spacing of approximately 0.5 mm or more, in particular 0.7 mm or more, from the side walls. This allows simpler deformation of the profile when corners of a spacer frame are constructed, since the regions having reduced thickness form a kind of articulation point such that deformation of the profile takes place in defined manner in the region of the inner wall. This measure is particularly significant if the inner wall is dimensioned to be thicker than in the central region of the profile cross section, for the purpose of completely embedding the first and second primary reinforcing elements. The result is that, during formation of the corner regions, the geometry of the side walls of the profile remains substantially unchanged.

The reduction in the thickness of the inner wall may be realised from the hollow chamber side and/or at the outside surface of the inner wall, which faces towards the interior of the insulating glass pane.

Similarly in addition to or as an alternative to these measures, the inner wall may be provided in its regions adjoining the side walls with through openings arranged at regular intervals in the longitudinal direction of the spacer, which on the one hand facilitate the deformation of the inner wall in relation to the side wall in a defined manner and on the other additionally facilitate gas exchange between the interior of the insulating glass pane and the hollow chamber of the spacer.

Typical diameters of primary reinforcing elements having a round cross section are approximately 0.5 mm to approximately 2 mm, particular approximately 0.7 to approximately 1.1 mm.

In cases where the reinforcing elements are not received completely within the inner wall, it is recommended to provide the outer surface of the primary reinforcing elements with a coating of adhesion promoter such that the connection between the plastics material of the profile body on the one hand and the reinforcing elements on the other is sufficiently great, and the adhesion to the profile body is substantially maintained even if there is deformation in a corner region.

The thickness of the inner wall of the profile body of the spacers according to the invention may be smaller in a region between the primary reinforcing elements than in the regions in which the primary reinforcing elements are arranged.

This allows a further increase in the heat transfer resistance to be achieved and at the same time material costs to be minimised.

In addition to the primary reinforcing elements, the spacers according to the invention may also be provided with further, in particular also filamentary, reinforcing elements.

In addition to the filamentary further reinforcing elements, foil materials are also suitable, wherein the latter are preferably arranged restricted to the outer wall and/or parts of the side walls.

The further reinforcing elements may in particular be arranged on and/or in the outer wall. In particular, the outer wall as a whole may be constructed as a further reinforcing element.

Preferably, when further reinforcing elements are used, the ratio of the total cross sectional surfaces of all the reinforcing elements in the inner wall to the total cross sectional surfaces of reinforcing elements in the outer wall may be approximately 2:1 to approximately 1:2.

In this way, favourable behaviour is achieved during cold forming of the elements to form the corner regions of spacer frames to be formed by the spacers.

Preferably, in the case of the arrangement of further reinforcing elements in the outer wall, care is taken that these further reinforcing elements have a higher elongation at break than the primary reinforcing elements arranged in the region of the inner wall. This also applies where the outer wall as a whole is constructed as a further reinforcing element.

On the basis of this measure, optimum bending properties of the spacer according to the invention are ensured.

It is further preferable for the selection and arrangement of the reinforcing elements as a whole to be such that, when the hollow profile is bent to form a corner region, it has a neutral axis which is arranged in a region of the cross section of the hollow profile that corresponds to approximately 40% to approximately 60% of the overall height. In this case, the neutral axis extends perpendicular to the longitudinal direction of the spacer and parallel to the inner wall.

Further preferred are spacers according to the invention in which, as a result of the material selected, there is a so-called overbend angle of approximately 20° or less for producing a portion bent at 90°.

Preferably, with spacers according to the invention, care is also taken that the first and second primary reinforcing elements are each arranged adjacent to a part of the hollow volume of the hollow profile in which, once the hollow profile has been bent at 90° around a bend axis extending perpendicular to the longitudinal direction and parallel to the inner wall, the inner wall and the outer wall are still spaced from one another. This has the result that the constraints on bending are minimised such that the force applied during bending and indeed deformations of the hollow profile arising from the cold forming are minimised. This further improves the appearance of the corner regions that are produced by cold forming.

In contrast to the prior art (such as WO 99/41481 A1), the primary reinforcing elements preferably maintain a marked spacing from the outer surface of the side walls, and are preferably arranged exclusively in the inner wall. During bending of the spacers according to the invention for the formation of corners, this prevents the filamentary reinforcing elements from being displaced to the outside and in some cases even appearing through the plastics material or in some cases damaging the side wall at its inside surface. Rather, the wires can yield in a part of the hollow volume of the hollow profile and so facilitate the bending procedure.

By comparison with an arrangement of the primary reinforcing elements towards the centre of the inner wall, as known for example from EP 0 601 488 A2, the particular arrangement according to the present invention makes possible a smaller radius of bending. The region of the spacer which is deformed (as seen in the longitudinal direction thereof) during the formation of a corner is reduced. Plastic deformation of the primary reinforcing elements begins at an earlier stage, with the result that smaller restoring forces are applied and a smaller overbend angle is needed.

These and further advantages of the invention will be explained in more detail below with reference to the drawing, in which the following are shown in detail:

BRIEF DESCRIPTION OF THE SEVERAL VIEWS OF THE DRAWING(S)

FIG. 1 shows a first embodiment of a spacer including primary reinforcement elements according to the invention, wherein

FIG. 3 shows a further embodiment of a spacer according to the invention;

FIG. 4 shows a further embodiment of a spacer according to the invention;

DETAILED DESCRIPTION OF THE INVENTION

Figure 1:
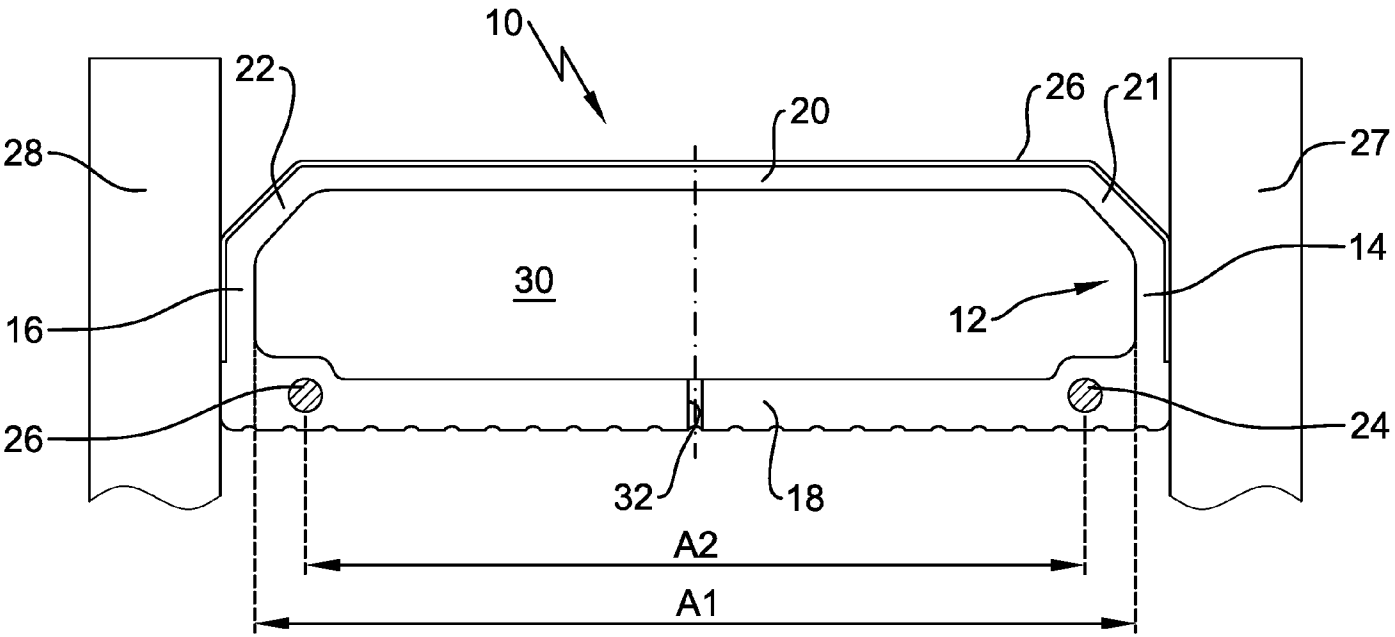

FIG. 1 shows a spacer 10 according to the invention, having a profile body which is made from plastics and forms, in one piece with an outer wall, a closed hollow profile 12 which has a substantially rectangular cross section. The hollow profile 12 is typically made by the extrusion method.

The hollow profile 12 includes two parallel side walls 14, 16 and an inner wall 18, which extends between the side walls 14, 16, and an outer wall 20 which adjoins the side walls 14, 16 and is aligned substantially parallel to the inner wall 18. The outer wall 20 adjoins the side walls 14 and 16 at two chamfered regions 21, 22.

In the assembled condition of an insulating glass pane, glass panes 27, 28 which are connected to the spacer 10 by way of an adhesive (not illustrated) abut against the parallel side walls 14, 16.

The chamfered regions 21, 22 each create a substantially triangular volume towards the glass panes 27, 28, and this can receive adhesive.

Figure 1C:
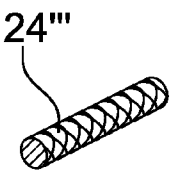
FIGS. 1A, 1B, and 1C show other forms of a primary reinforcement element.
Figure 1B:
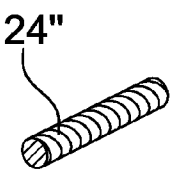
Figure 1A:
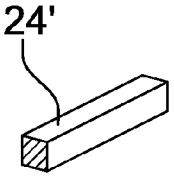

Embedded in the hollow profile, in the region of the inner wall 18, are a first and a second primary reinforcing element 24, 26 in the form of a wire of circular cross section. The inner wall 18 is thicker in the regions in which the reinforcing elements 24, 26 are embedded than in the region lying in between. FIG. 1A shows a primary reinforcing element 24' having a rectangular cross-section, FIG. 1B shows a first primary reinforcing element 24" having a threaded surface, and FIG. 1C shows a first primary reinforcing element 24'" having a knurled surface.

Provided on the outer wall 20 and the chamfered regions 21, 22 and large regions of the side walls 14, 16 is a peripheral diffusion barrier coating 26 which is substantially impermeable to water vapour and is made for example from metal, in particular stainless steel. Instead of a metal foil, the diffusion barrier coating 26 may also be formed by a plastics toil having appropriate properties or a coating, in particular a vapour-deposition metal coating, an applied plastics coating or an extruded-on plastics coating.

The hollow profile 12 surrounds a hollow space 30 which communicates by way of through openings 32 in the inner wall 18 with the volume enclosed in the insulating glass pane. The through openings are arranged in a regular distribution in the longitudinal direction of the spacer 10.

In the installed condition of the spacer in an insulating glass pane, the hollow chamber 30 receives desiccant which serves to absorb moisture from the interior of the insulating glass pane.

By comparison with its overall height, the spacer 10 in FIG. 1 has a relatively great width, which may in reality be for example 24 mm, the height of the spacer typically being approximately 6 mm to approximately 7.5 mm. The spacing A2 between the centroids of the cross sectional surfaces of the primary reinforcing elements 24 and 26 is approximately 90% of the spacing A1 between the side walls 14 and 16.

The plastics material from which the hollow profile 12 is made is in the present case polypropylene (PP) and is free of reinforcing fibres.

The strength of the profile is substantially determined by the primary reinforcing elements 24, 26 and in some cases by the diffusion barrier coating 26, where the latter is made from a metal coating in the form of a foil, for example a steel foil. The thickness of the metal coating may be small, for example approximately 0.1 mm or less, for example approximately 0.05 to approximately 0.08 mm.

The spacer 10 may be deformed by means of cold forming to give corner regions which are required for forming a, for example, rectangular frame, which is laid between the two glass panes 27, 28 and glued.

Figure 2A:
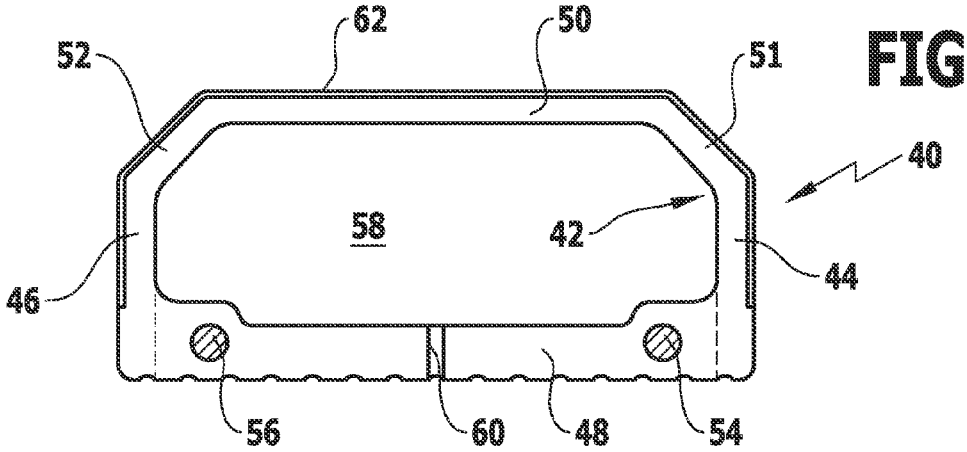
FIGS. 2A to 2C show three variants of a further embodiment of a spacer according to the invention.
Figure 2B:
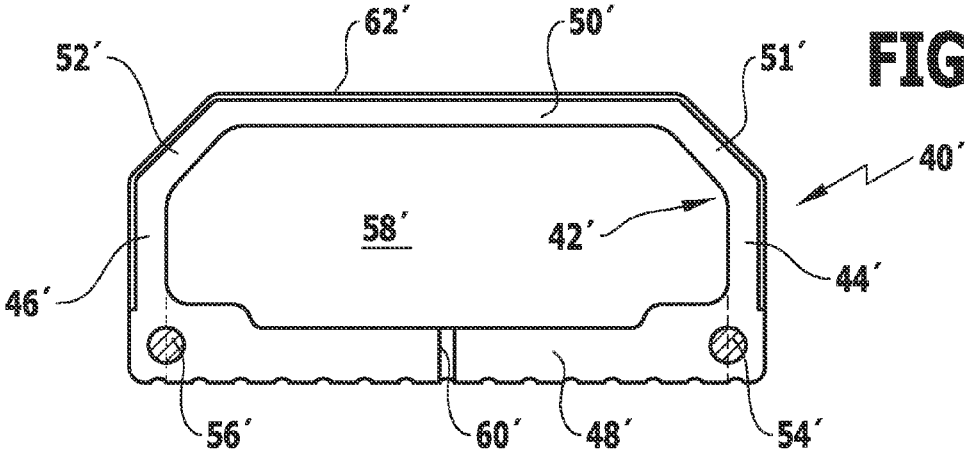
Figure 2C:
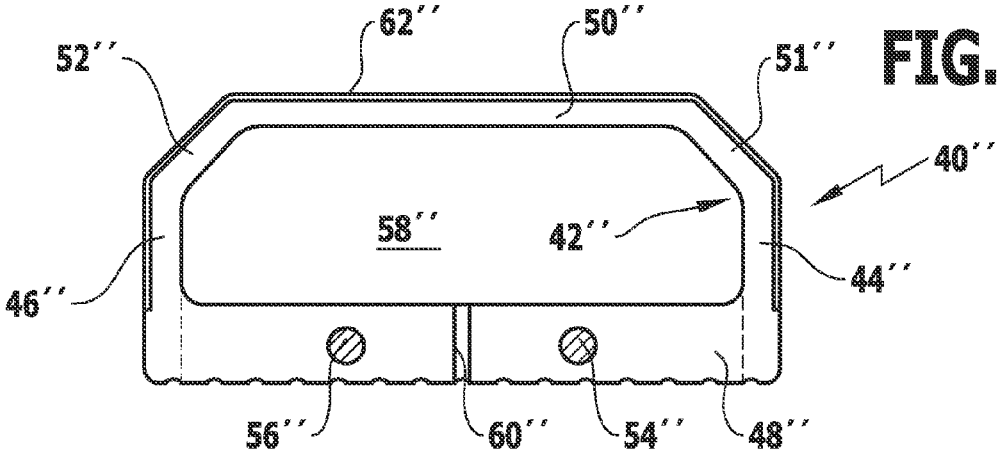

FIGS. 2A to 2C show three variants of a spacer 40 according to the invention, which in order to distinguish it is designated 40' and 40" respectively in FIGS. 2B and 2C. Like reference numerals are used for like profile features.

The underlying structure of the spacer in FIGS. 2A to 2C is the same, with the exceptions to be discussed below.

The spacer 40 in FIG. 2A includes a closed plastics hollow profile 42 having side walls 44, 46 which are arranged parallel to one another and between which there extends an inner wall 48 and an outer wall 50, here too with chamfered regions 51, 52. Here too, the profile body comprising the side walls 44, 46 and the inner wall 48 is extruded in one piece with the outer wall 50 and its chamfered regions 51, 52.

Received in the hollow profile 42, on the inner wall 48 side, are primary reinforcing elements 54, 56, and the inner wall 48 is constructed to be thicker in the region of the reinforcing elements 54, 56 than in the region tying in between.

The hollow profile 42 surrounds a hollow space 58 which can communicate with the outside of the inner wall 48 by way of perforation through openings 60.

On the outside of the outer wall 50 and the chamfered regions 51, 52 and large parts of the adjoining side walls 44, 46 there is applied, in particular glued, a metal foil 62 made from stainless steel which acts as a diffusion barrier coating.

Common to the embodiments in FIG. 1 and FIG. 2A is the positioning of the reinforcing elements 24, 26 and 54, 56, both of which are arranged offset from the regions of the side walls 14, 16 and 44, 46 respectively. Here too, the specification that the spacing between the centroids of the cross sectional surfaces of the primary reinforcing elements 24, 26 and 54, 56 is at least 40% or more of the spacing between the side walls, but at least 4 mm, is observed.

Similarly, the complete cross sectional surface of the reinforcing elements 24, 26 is located in the inner wall 18, with the result that the measure that at most 50% of the cross sectional surface of the reinforcing elements 24, 26 and 54, 56 respectively can be received in the regions of the side walls 14, 16 and 44, 46 is also fulfilled.

The diameter of the primary reinforcing elements 24, 26 and 54, 56 is approximately 0.8 min, and the thickness of the walls 14, 16 and 44, 46 is approximately 0.9 mm.

In the region in which the primary reinforcing elements 24, 26 and 54, 56 are received, the thickness of the inner wall 18 and 48 respectively is approximately 1.8 mm, that is to say about 2.2× the diameter of the reinforcing elements.

FIG. 2B shows a spacer 40' according to the invention which has a hollow profile 42' that differs from the hollow profile 42 in FIG. 2A only in that reinforcing elements 54', 56' are received in a different position in the cross section of the hollow profile 42', such that approximately 50% of their cross sectional surface is arranged in the first and second side wall 44' and 46' respectively.

The further variant shown in FIG. 2C relates to a spacer 40" of the present invention in which once again the underlying structure of the spacer of FIG. 2A is used, but wherein the primary reinforcing elements 54" and 56" have their centroids of the cross sectional surfaces brought closer together, but still maintain a spacing of 40% of the spacing between the side walls 44" and 46" and at least 4 mm. The inner wall 48" here has a uniform thickness of 1.8 mm over the entire width.

FIG. 3 shows a spacer 70 according to the invention which is of comparatively narrow construction, having a width of approximately 8 mm, and with an overall height of approximately 7 mm has an almost square cross section. The spacer 70 includes a closed hollow profile 72, which has parallel side walls 74, 76 and inner and outer walls 78, 80 that extend between the side walls 74, 76. The hollow profile, which comprises a profile body (side walls 74, 76 and inner wall 78) and the outer wall 80, is extruded as a one-piece body.

The outer wall 80 once again adjoins the side walls 74 and 76 by way of chamfered regions 81, 82 respectively.

Two primary reinforcing elements 84, 86 which are in the form of a wire of circular cross section are arranged in the inner wall 78, maintaining the minimum spacing of 4 mm between the centroids of the cross sectional surfaces of the reinforcing elements. Furthermore, the spacing is approximately 65% of the spacing between the side walls 74, 76.

The hollow profile 72 surrounds a hollow volume 88 which is available for filling with desiccants. The desiccant in the hollow volume 88 is connected to the outer surface of the inner wall 78 by way of perforation through holes 90.

On the outer wall 80, the chamfered regions 81, 82 and large parts of the side walls 74, 76 there is arranged a barrier coating 92 made from a stainless steel foil.

FIG. 4 shows a further exemplary embodiment of the present invention using a variation of the geometry as shown in FIG. 2C.

The spacer 100 has a closed hollow profile 103 made from plastics material, in which side walls 104, 106 are arranged parallel to one another and wherein an inner wall 108 extends between these side walls 104, 106. The outer wall 110 adjoins the side walls 104 and 106 by way of chamfered regions 111, 112 respectively.

Arranged in the inner wall 108 there are, in addition to the primary reinforcing elements 114, 116, two further reinforcing elements 118, 120 which are all made from a wire of circular cross section.

In addition to the reinforcing elements in the inner wall 108, three reinforcing elements 121, 122, 123 are arranged in the outer wall 110 and these are also in the form of wires but have an oval cross section.

The ratio of the cross sectional surfaces of the reinforcing elements, 114, 116, 118, 120 of the inner wall to the cross sectional surfaces of the reinforcing elements 121, 122, 123 is approximately 1.2. Because of the further slight thickening effect of the barrier coating 124, the neutral axis N is approximately half way up (50%) the overall cross section of the hollow profile 102.

The complete profile 102 surrounds a hollow volume 126 which can receive a desiccant. The hollow volume 126 is accessible by way of perforation through holes 128.

Figure 5A:
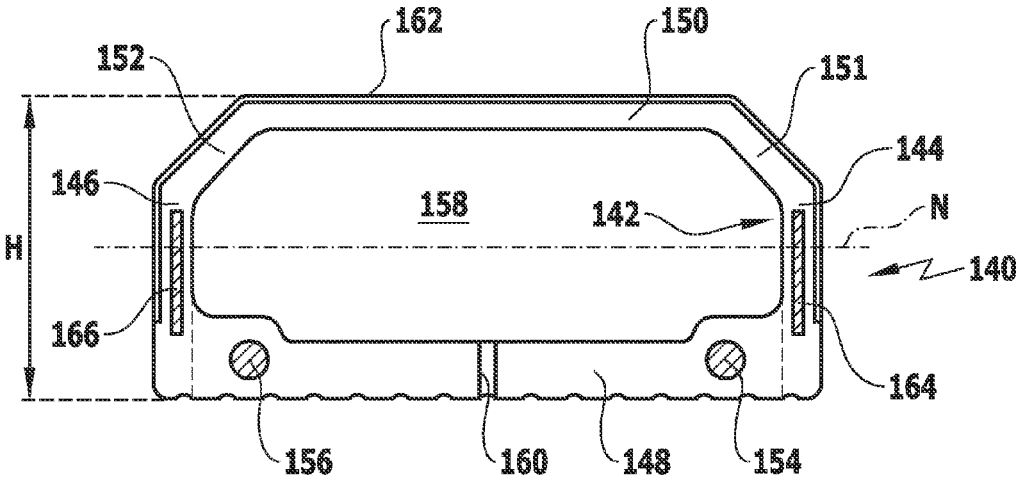
FIGS. 5A and 5B show further embodiments of a spacer according to the invention.

FIG. 5A shows a spacer 140, the geometry of which is derived from the spacer 40 in FIG. 2A and which includes a closed plastics hollow profile 142 having side walls 144, 146 which are arranged parallel to one another and between which an inner wall 148 and an outer wall 150, here too having chamfered regions 151, 152, extend.

Primary reinforcing elements 154, 156 are received in the hollow profile 142 on the inner wall 148 side, and the inner wall 148 is constructed to be thicker in the region of the reinforcing elements 154, 156 than in the region lying in between.

The hollow profile 140 surrounds a hollow space 158 which can communicate with the outside of the inner wall 148 by way of through openings 160.

On the outside of the outer wall 150 and the chamfered regions 151, 152 and large parts of the adjoining side walls 144, 146 there is applied, in particular glued, a metal foil 162 made from stainless steel which acts as a diffusion barrier coating.

The diameter of the primary reinforcing elements 154, 1156 is approximately 0.8 mm, and the thickness of the walls 144, 146 is approximately 0.9 mm.

In the region in which the primary reinforcing elements 154, 156 are received, the inner wall 148 is approximately 1.8 mm thick, that is to say around approximately 2.2× the diameter of the reinforcing elements 154, 156.

By comparison with FIG. 2A, the spacer 140 has two further reinforcing elements 164, 166 which take the form of metal strips.

Because of the cross section of the reinforcing elements 164, 166, they can be completely received in the wall of the side walls 144, 146, whereof the thickness can still be the original dimension of approximately 0.9 mm.

Here too, the neutral axis N is approximately 50% of the way up the overall height H of the hollow profile 142, provided a suitable selection is made for material for the barrier coating 162 and the coating thickness thereof.

Figure 5B:
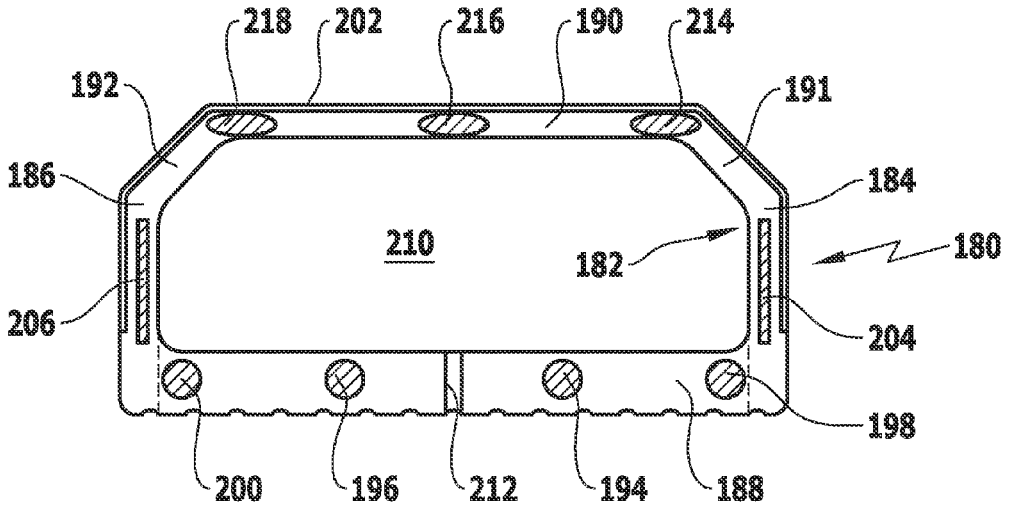

The variant of a spacer 180 according to the invention in FIG. 5B refers back to the embodiment in FIG. 4, wherein here a closed hollow profile 182 is constructed with side walls 184, 186, an inner wall 188 and an outer wall 190 having chamfered regions 191, 192 by means of which the outer wall 190 adjoins the side walls 184, 186.

Primary reinforcing elements 194, 196 are received in the inner wall 188. Supplementary reinforcing elements 198, 200 are arranged in the inner wall 188 adjacent to the side walls 184, 186.

Furthermore, the side walls 184, 186 include reinforcing elements 204, 206 which take the form of metal strips, with the result that they simply fit within the predetermined cross section of the side walls 184, 186.

Reinforcing elements of oval construction are received in the outer wall 190 and are designated by the reference numerals 214, 216, 218.

The hollow profile 182 surrounds a hollow volume 210 which is accessible by way of through openings 212 in the inner wall 188.

On the outer wall 190, the chamfered regions 191, 192 and large parts of the side walls 184, 186 there is once again arranged a vapour barrier coating 202.

The reinforcing elements 204, 206 that are arranged in the side walls 184, 186 lie approximately within the range of the neutral axis of the spacer 180.

The hollow profiles of the spacers 140 and 180 in FIGS. 5A and 5B are each extruded in one piece.

Figure 6A:
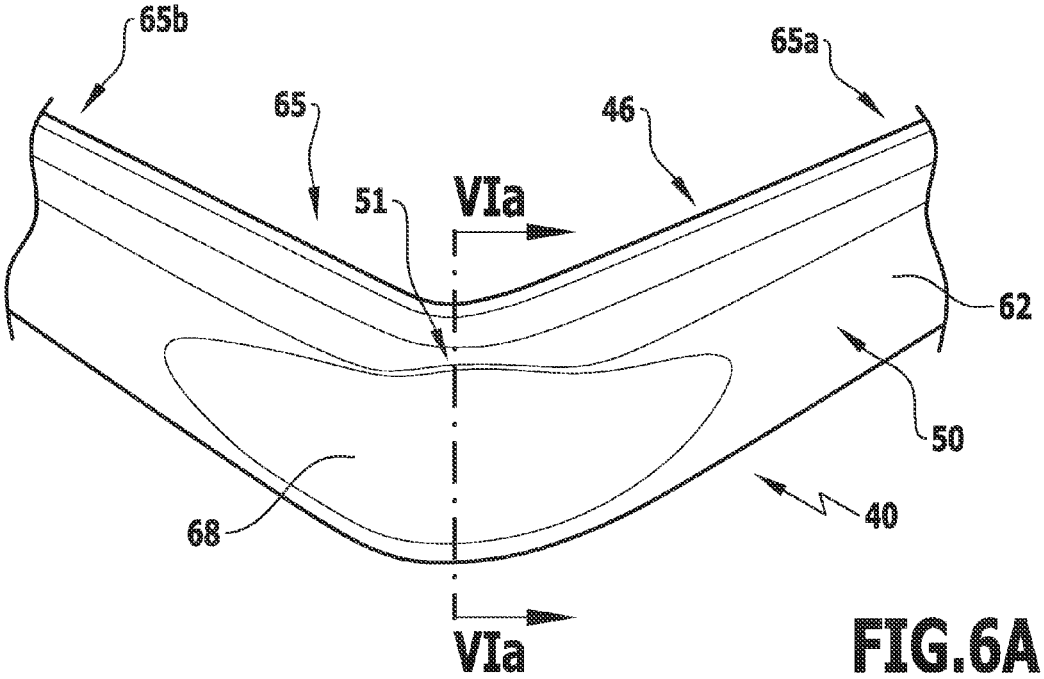
FIGS. 6A to 6C show various illustrations of a portion of a spacer according to the invention which has been bent into a corner region according to FIG. 2A.
Figure 6B:
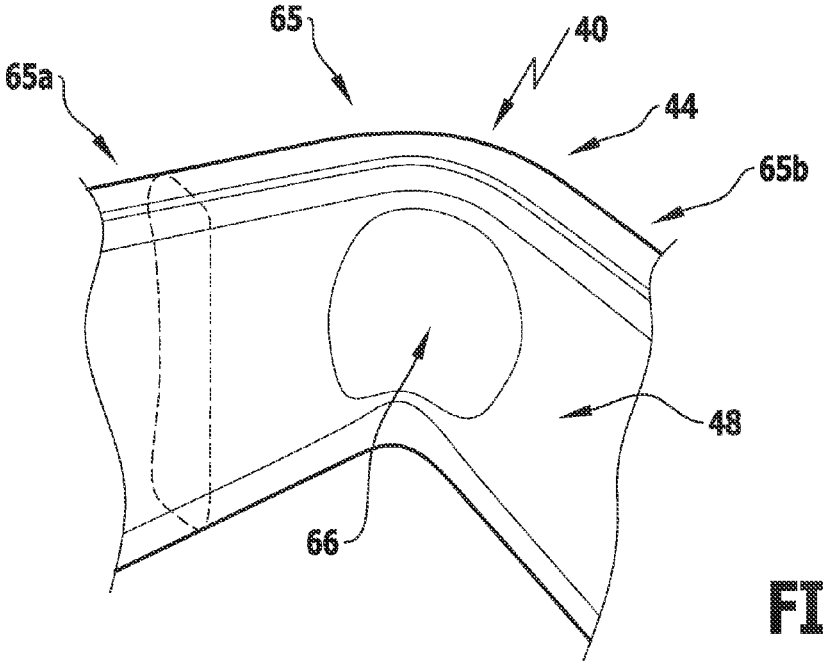
Figure 6C:
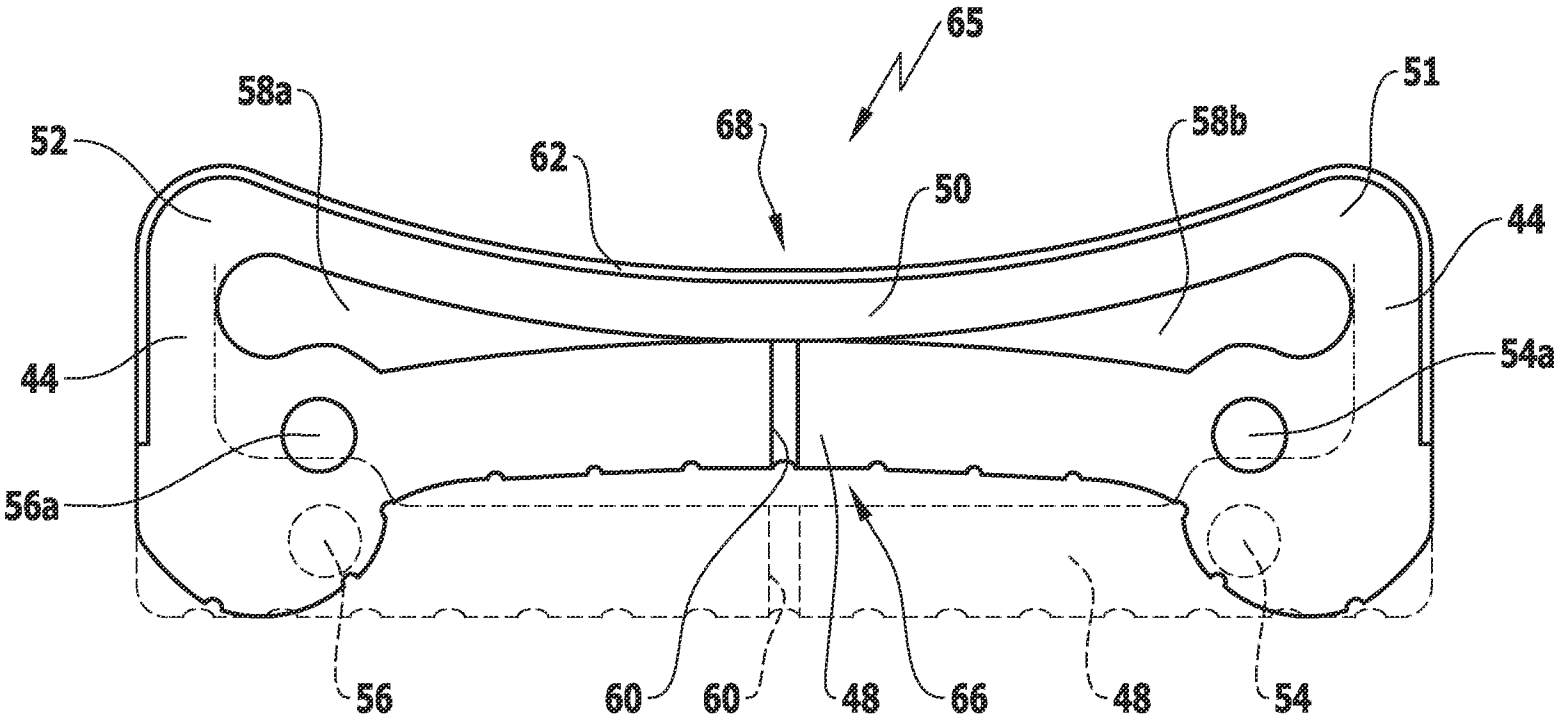

FIGS. 6A to 6C show a portion of the spacer 40 from FIG. 2A which has been bent to give a corner region 65.

FIGS. 6A and 6B show the corner region 65 in perspective illustration, from the side with the outer wall 50 and the diffusion barrier 62 that is glued onto it, and from the side with the inner wall 48 respectively. To produce the corner region 65, a bending die (not illustrated), the width of which may be smaller than the extent of the inner wall 48 between the side walls 44, 46 is pressed against the inner wall 48, and the spacer is then bent by somewhat more than 90° around the bending die such that the corner region 65 is obtained with limbs 65*a*, 65*b* at an angle of 90°.

Because of the tensile and compressive forces that occur during this cold forming, a permanent deformation of the plastics hollow profile, the (primary reinforcing elements 54, 56 received therein and the barrier coating 62 is obtained. A depression 66 which is recessed from the inner wall surfaces 48 of the limbs 65*a*, 65*b* is produced on the inside of the corner region. A bulge 68 in the outer wall 50 of the limbs 65*a*, 65*b* is obtained on the outside.

FIG. 6C shows the corner region 65 in a sectional illustration along the line VIa-VIa, partially supplemented by the outer contour of the spacer 40 before cold forming. It is clear from the cross section that the inner surfaces of the outer wall 50 and the inner wall 48 approach one another, and depending on the geometry of the plastics hollow profile even abut against one another.

The originally present single hollow space 58 is reduced and two partial spaces 58*a*, 58*b* remain.

In the course of deformation of the inner wall 48, the primary reinforcing elements received there, together with parts of the inner wall 48, move towards the approaching outer wall 50, resulting in the positions 54*a* and 56*a* for the primary reinforcing elements.

Because of the inventive construction of the spacer, in particular the arrangement of the primary reinforcing elements 54, 56 in the region of the inner wall 48, the deformation can be carried out without this resulting in undesirable deformations of the side walls 44, 46 and without the primary reinforcing elements 54, 56 hampering the cold forming.

Figure 7:
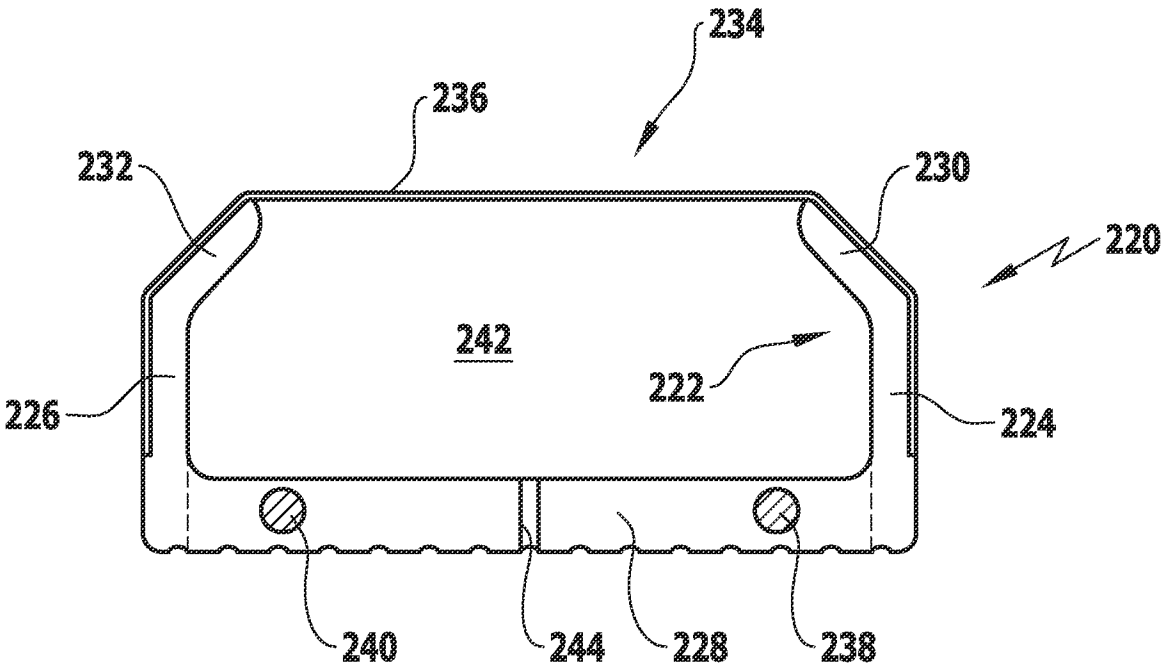
FIG. 7 shows a further embodiment of a spacer according to the invention.

Finally, FIG. 7 shows a spacer 220 having a profile body 222 which is formed from a plastics material with side walls 224, 226 and an inner wall 228. The side walls 224, 226 carry wall regions 230, 232 which are chamfered at their free ends remote from the inner wall 228.

A metal foil 236 is added to the profile body 222 in order to create a closed hollow profile 234, this metal foil forming, with the chamfered wall regions 230, 232, the outer wall of the hollow profile 234. At the same time, the metal foil 236 serves as a diffusion barrier. For this reason, it also extends beyond the chamfered wall regions 230, 232 and covers large parts of the side walls 224, 226.

A first and a second primary filamentary reinforcing element 238, 240 are embedded in the inner wall 228.

In this exemplary embodiment, the metal foil 236 also acts as a further reinforcing element.

The hollow volume 242 surrounded by the hollow profile 234 is in connection by way of through openings 244 in the inner wall 228 with the intermediate space between the panes of an insulating glass unit which is formed using the spacer 220.

Figure 8A:
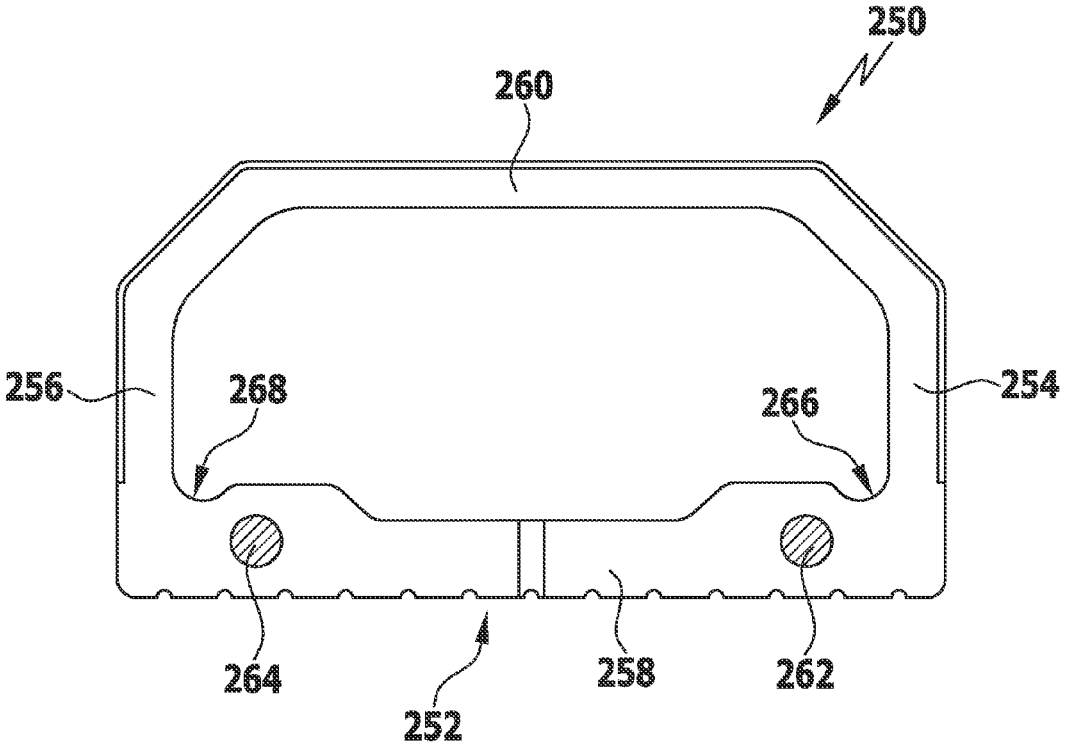
FIGS. 8A to 8C show further embodiments of a spacer according to the invention.

FIG. 8A shows a spacer 250 having a hollow profile body 252 which is formed from a plastics material and has side walls 254, 256, an inner wall 258 and an outer wall 260.

Primary first and second reinforcing elements 262, 264 are arranged completely embedded in the inner wall 258. The regions of the inner wall that receive the primary reinforcing elements 262, 264 are thicker than the region lying in between, in order to completely embed the reinforcing elements 262, 264 in the plastics material.

In the regions 266, 268 directly adjoining the side walls 254, 256, the inner wall 258 has a reduced thickness so that the inner wall 258 adjoins the side walls 254, 256 by way of a type of articulation. This ensures that the geometry of the side walls is substantially retained when corners are formed as shown in FIGS. 6A to 6C, such that the glass panes of the insulating glass pane abut in optimum manner even in the corner region.

In the exemplary embodiment shown in FIG. 8A, the outer contours of the primary first and second reinforcing elements maintain a spacing from the side walls which corresponds approximately to the diameter of the reinforcing elements, in the present case approximately 0.8 mm.

Further examples of modifying the way the inner wall is attached to the side walls of the spacer according to the invention are shown in FIGS. 8B and 8C, in which again the inner wall is modified such that a type of articulation is formed and deformation of the spacer for the purpose of forming corners for the spacer frame is facilitated.

Figure 8B:
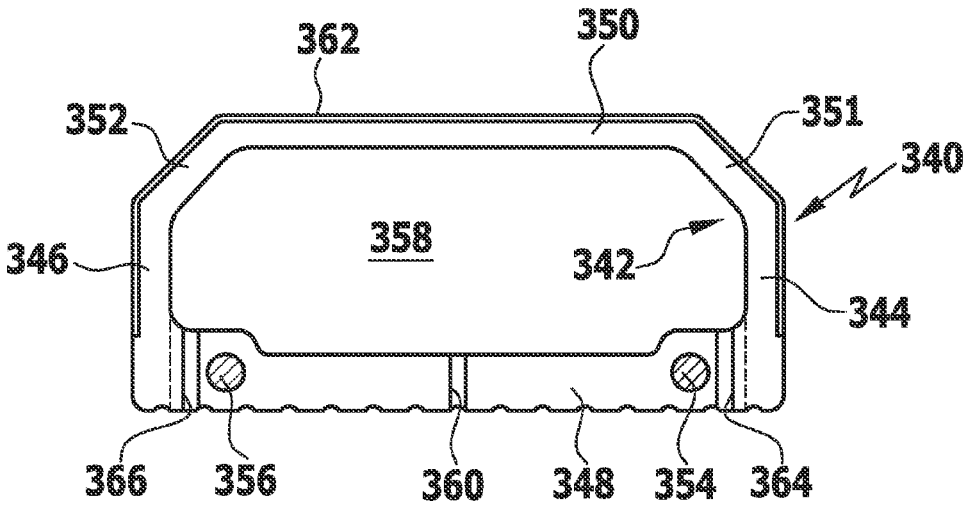
Figure 8C:
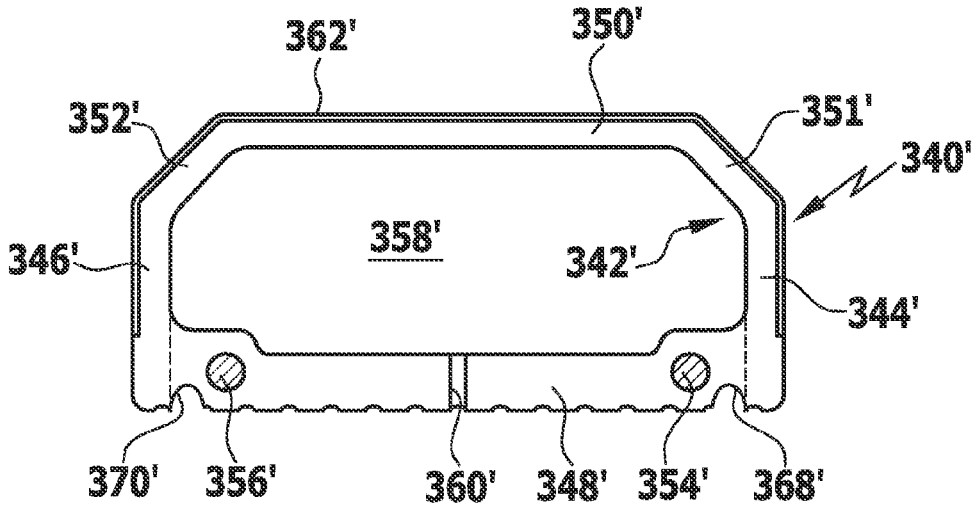

The exemplary embodiments of FIGS. 8B and 8C, that is to say the spacers 340 and 340' respectively, are substantially based on the embodiment which was already shown in the context of FIG. 2A.

The spacers in FIGS. 8B and 8C also have a closed hollow profile 342, 342' with side walls 344, 346 which are arranged parallel to one another and between which there extend an inner wall 348 and an outer wall 350. Moreover, the outer wall 350 is once again connected to the side walls 344 and 346 respectively by way of chamfered regions 351, 352. The profile body of the plastics hollow profile 342 is extruded as a whole in one piece.

Primary reinforcing elements 354, 356 are received in the hollow profile 342 on the inner wall 348 side, and the inner wall 348 is constructed to be thicker in the region of the reinforcing elements 354, 356 than in the region of the profile centre lying in between.

The hollow profile 342 surrounds a hollow space 358 which can communicate, by way of perforation through openings 360, with the outside of the inner wall 348, which is adjoined in the assembled condition of an insulating glass pane by the insulating glass pane interior.

On the outside of the outer wail 350 and the adjoining chamfered regions 351, 352 and large parts of the side parts of the side walls 344, 346 there is applied, in particular glued, a metal foil 362, preferably made from stainless steel, which acts as a diffusion barrier coating.

In addition to the construction features of the profile 40 in FIG. 2A, in FIG. 8B through openings 364, 366 are arranged in the spacer 340, on the inner wall 348 side and at regular intervals along the length of the spacer profile 340, and these on the one hand enable a gas exchange, in addition to the perforation openings 360, between the hollow chamber 358 and the outside of the inner wall 348 and the interior of the insulating glass pane that is later produced.

On the other hand, the through openings 364, 366, which are repeated at regular intervals along the profile, result in a type of articulation function by means of which deformation of the inner wall 348 is supported in a defined manner when the corners are formed for the purpose of forming a spacer frame.

In the case of the embodiment 340', the same features apply to the basic structure of the spacer profile 342' as was described earlier in the context of FIG. 8B. For this reason, the reference numerals are also given the same numbers.

Unlike the embodiment in FIG. 8B, however, the spacer 340' in FIG. 8C does not have additional through openings 364, 366 but channel-like depressions 368', 370' which extend in the longitudinal direction of the spacer 340', on the outside of the inner wall 348'.

Once again, in this way the reduced thickness of the inner wall in its region by which it adjoins the side walls 344' and 346' respectively results in the formation of a type of articulation such that, here too, as already described in connection with the embodiments of the spacer in FIGS. 8A and 8B, deformation of the inner wall 348' in relation to the side walls 344' and 346' is facilitated in a defined manner when corners are formed for the purpose of forming a spacer frame.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A spacer for insulating glass panes, including a profile body made from plastics material which has a substantially rectangular cross section having first and second mutually parallel side walls and an inner wall that extends between the first and the second side wall, wherein glass panes abut against the first and second side wall, the spacer further comprising an outer wall that extends between the first and the second side wall, substantially parallel to the inner wall, the profile body forming a closed single cavity hollow profile, wherein the spacer comprises a first and a second filamentary primary reinforcing element each having an outer contour, a cross sectional surface and a centroid, the first filamentary primary reinforcing element and the second filamentary primary reinforcing element being arranged spaced apart from each other in a part of the inner wall and parallel to an axial direction of the spacer profile body, such that the spacing between the centroids of the cross sectional surfaces of these reinforcing elements is approximately 50% or more of the spacing between the side walls, and the spacing is at least approximately 4 mm, the cross sectional surfaces being completely in the parts of the inner wall and their outer contours maintain a spacing of approximately 0.5 mm or more to the side walls, and wherein the first and second primary reinforcing elements are each arranged adjacent to a part of the hollow volume of the hollow profile in which, once the hollow profile has been bent at 90° around a bend axis extending perpendicular to the longitudinal direction and parallel to inner wall, the parts of the inner wall accommodating the first and the second primary reinforcing elements are spaced from the outer wall.

2. The spacer according to claim 1, wherein the outer wall is made from plastics material.

3. The spacer according to claim 1, wherein the spacing between the centroids of the cross sectional surfaces of the primary reinforcing is at least approximately 5 mm.

4. The spacer according to claim 1, wherein the cross section of the filamentary primary reinforcing elements is rectangular, round or oval.

5. The spacer according to claim 1, wherein at least the outer wall is provided with or forms a diffusion barrier.

6. The spacer according to claim 1, wherein the plastics material of the hollow profile comprises PP, PC, PVC, SAN, polyester, PA and/or ABS.

7. The spacer according claim 1, wherein the first filamentary primary reinforcing element and the second filamentary primary reinforcing element each have a weight, and the profile body plastics material has a weight, and a weight ratio between the weight of the primary reinforcing elements and the weight of the plastics material is approximately 1:6 to approximately 2:1.

8. The spacer according to claim 1, wherein the plastics material has a content of reinforcing fibres which is approximately 20 weight % or less.

9. The spacer according claim 1, wherein the plastics material includes additives.

10. The spacer according claim 1, wherein the inner wall has a thickness, at least in the regions thereof in which the first and second primary reinforcing elements are arranged, which is approximately 1× to approximately 2.5× of the cross sectional surface of the primary reinforcing elements in a direction of the thickness of the inner wall.

11. The spacer according claim 1, wherein the thickness of the inner wall is smaller in a central region between the primary reinforcing elements than in the regions in which the primary reinforcing elements are arranged.

12. The spacer according claim 1, wherein the profile body has a centre, and the inner wall has a thickness that is reduced, directly adjacent to the side walls, by comparison with the adjoining region of the inner wall in a direction of the profile body centre.

13. The spacer according to claim 1, wherein in the hollow profile there are arranged, in addition to the first and second filamentary primary reinforcing elements, further reinforcing elements.

14. The spacer according to claim 13, wherein at least one of the further reinforcing elements is arranged on and/or in the outer wall.

15. The spacer according to claim 14, wherein a ratio of the total cross sectional surfaces of all the reinforcing elements in the inner wall to the total cross sectional surface of reinforcing elements in the outer wall is approximately 2:1 to approximately 1:2.

16. The spacer according to claim 14, wherein the reinforcing element(s) arranged in the region of the outer wall have a higher elongation at break than the reinforcing elements arranged in the region of the inner wall.

17. The spacer according to claim 1, wherein the hollow profile has an overall height, and a longitudinal direction, when the hollow profile is bent, it has a neutral axis which is perpendicular to the longitudinal direction and parallel to the inner wall and is arranged in a region approximately 40% to approximately 60% of the way up the overall height of the hollow profile.

18. The spacer according to claim 1, wherein the hollow profile has an overbend angle of approximately 20° or less for producing a portion bent at 90°.

19. The spacer according to claim 1, wherein the outer wall is itself constructed as a reinforcing element.

20. The spacer according to claim 2, wherein the plastics material is compatible or identical with the plastics material of the profile body.

21. The spacer according to claim 20, wherein the outer wall is extruded in one piece with the profile body.

22. The spacer according to claim 4, wherein the filamentary primary reinforcing elements each have a surface that is knurled, or provided with an externally threaded structure, and/or is provided with a coating of adhesion promoter.

23. The spacer according to claim 5, wherein the diffusion barrier is selected from a metal or plastics foil that is impermeable to water vapour, a metal coating that is applied to the hollow profile or a plastics coating that is applied to the hollow profile or co-extruded therewith.

24. The spacer according to claim 8, wherein the plastics material has a content of reinforcing fibres which is approximately 10 weight % or less.

25. The spacer according to claim 9, wherein the plastics material includes additives selected from fillers, pigments, light stabilisers, impact modifiers, antistatic agents and/or flame retardants.

26. The spacer according to claim 11, wherein the inner wall has a thickness, at least in the regions thereof in which the first and second primary reinforcing elements are arranged, which is approximately 1.5× to approximately 2.5× of the cross sectional surface of the primary reinforcing elements in a direction of the thickness of the inner wall.

27. The spacer according to claim 15, wherein the reinforcing element(s) arranged in the region of the outer wall have a higher elongation at break than the reinforcing elements arranged in the region of the inner wall.

28. The spacer according to claim 19, wherein, when the outer wall is a diffusion barrier, the outer wall is made from a metal foil.

29. The spacer according to claim 24 wherein the plastic is substantially free of reinforcing fibres.

* * * * *